US011711652B2

(12) United States Patent
Kakee et al.

(10) Patent No.: US 11,711,652 B2
(45) Date of Patent: Jul. 25, 2023

(54) REPRODUCTION DEVICE, REPRODUCTION SYSTEM AND REPRODUCTION METHOD

(71) Applicant: DENSO TEN Limited, Kobe (JP)

(72) Inventors: Yohei Kakee, Kobe (JP); Yoshikuni Miki, Kobe (JP); Hisanari Kimura, Kobe (JP)

(73) Assignee: DENSO TEN Limited, Kobe (JP)

( * ) Notice: Subject to any disclaimer, the term of this patent is extended or adjusted under 35 U.S.C. 154(b) by 22 days.

(21) Appl. No.: 17/478,244

(22) Filed: Sep. 17, 2021

(65) Prior Publication Data

US 2022/0303685 A1 Sep. 22, 2022

(30) Foreign Application Priority Data

Mar. 17, 2021 (JP) ..... 2021-043542

(51) Int. Cl.
*H04R 5/02* (2006.01)

(52) U.S. Cl.
CPC ..... *H04R 5/02* (2013.01)

(58) Field of Classification Search
CPC ..... H04R 5/02
See application file for complete search history.

(56) References Cited

U.S. PATENT DOCUMENTS

2019/0105568 A1* 4/2019 Platt ..... A63F 13/52

FOREIGN PATENT DOCUMENTS

JP 2021-009647 A 1/2021

* cited by examiner

*Primary Examiner* — Andrew L Sniezek
(74) *Attorney, Agent, or Firm* — Oliff PLC

(57) ABSTRACT

A reproduction device includes: an acquisition unit configured to acquire sound source information about a sound source; a determination unit configured to determine an output characteristic of the sound source with a virtual speaker arranged in a virtual space, based on a positional relationship between the virtual speaker and a virtual listener arranged in the virtual space; and a reproduction unit configured to reproduce the sound source with a real speaker arranged in a real space, based on the output characteristic determined by the determination unit.

16 Claims, 6 Drawing Sheets

REPRODUCTION DEVICE, REPRODUCTION SYSTEM AND REPRODUCTION METHOD

CROSS-REFERENCE TO RELATED APPLICATIONS

This application is based on and claims priorities under 35 USC 119 from Japanese Patent Application No. 2021-043542 filed on Mar. 17, 2021, the content of which is incorporated herein by reference.

TECHNICAL FIELD

The present invention relates to a reproduction device, a reproduction system and a reproduction method.

BACKGROUND ART

In the related art, for example, suggested is technology of expressing audio and video recorded in a real space such as a concert hall in a virtual space such as VR or AR, thereby enabling a user to feel as if the user were in the concert hall, even in a remote location (see JP-A-2021-9647 for instance).

SUMMARY OF INVENTION

In representation using sound in the virtual space, since an output source of a sound source is a speaker in a space where a user wearing a VR device or an AR device actually exists (for example, a room), there is a concern of lacking in realistic sensation.

The present invention has been made in view of the above situations, and an object thereof is to provide a reproduction device, a reproduction system and a reproduction method capable of enhancing realistic sensations.

To achieve the object thereof, a reproduction device according to the present invention includes: an acquisition unit configured to acquire sound source information about a sound source; a determination unit configured to determine an output characteristic of the sound source with a virtual speaker arranged in a virtual space, based on a positional relationship between the virtual speaker and a virtual listener arranged in the virtual space; and a reproduction unit configured to reproduce the sound source with a real speaker arranged in a real space, based on the output characteristic determined by the determination unit.

According to the present invention, it is possible to enhance realistic sensations.

DESCRIPTION OF EMBODIMENTS

Hereinafter, an embodiment of the reproduction device, the reproduction system and the reproduction method of the present disclosure will be described in detail with reference to the accompanying drawings. Note that, the present invention is not limited to the embodiment to be described later.

Figure 1A:
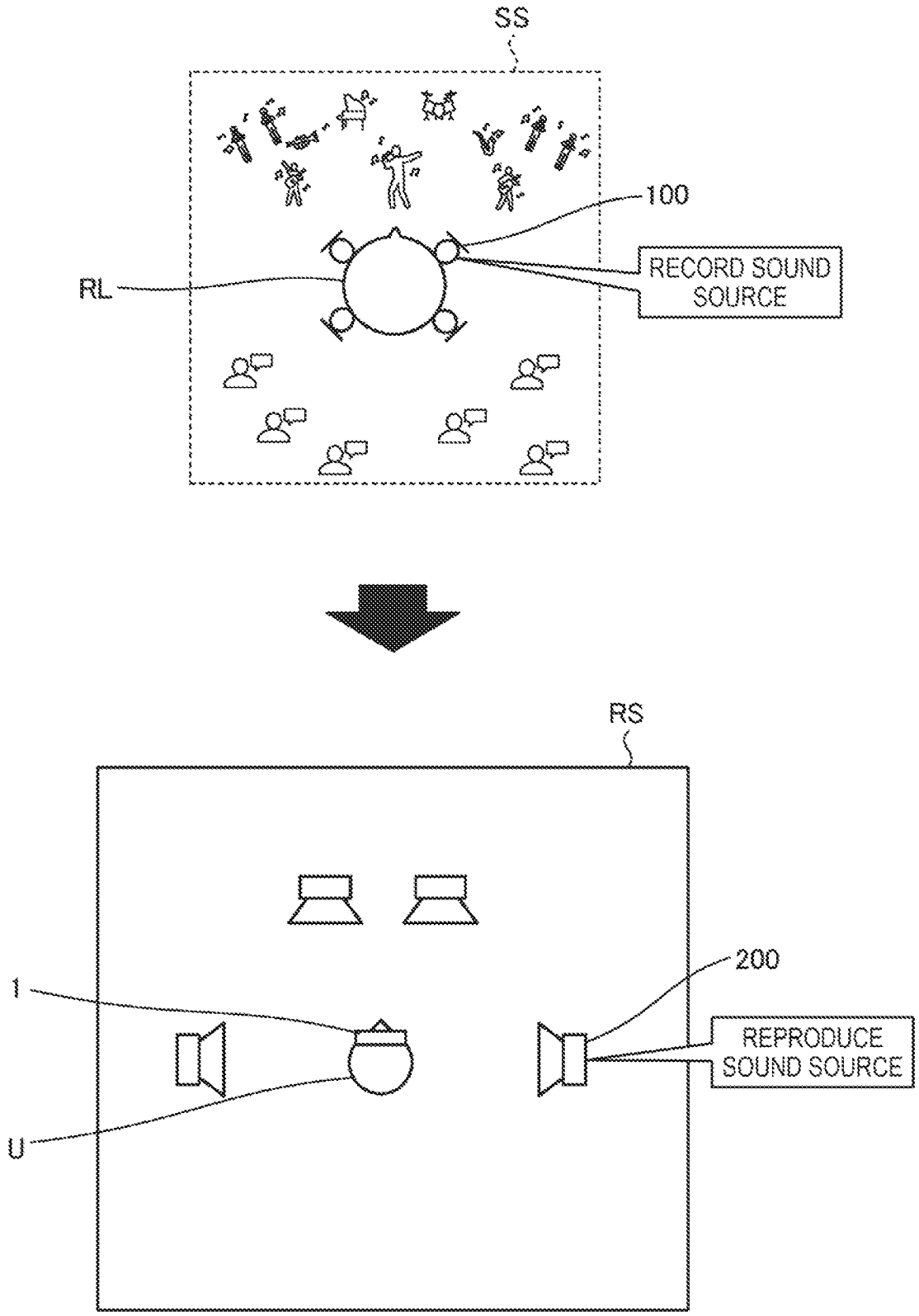
FIG. 1A shows an outline of a reproduction method according to an embodiment.
Figure 1B:
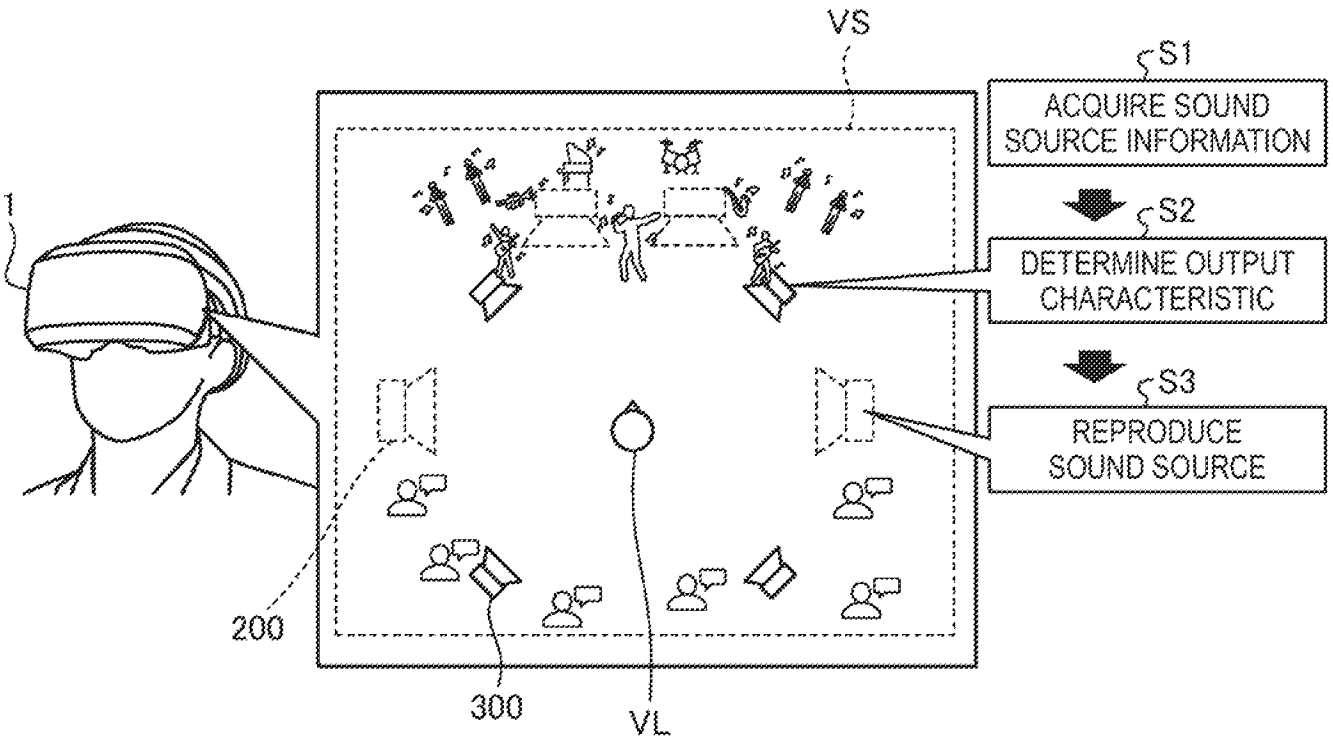
FIG. 1B shows the outline of the reproduction method according to the embodiment.

First, an outline of the reproduction method according to the embodiment is described with reference to FIGS. 1A and 1B. FIGS. 1A and 1B show an outline of the reproduction method according to the embodiment. The reproduction method according to the embodiment is executed by a reproduction device 1 shown in FIGS. 1A and 1B.

As shown in FIG. 1A, in the present disclosure, in an acoustic space SS that is a real space such as a concert hall and a live hall, a listener RL (hereinafter, referred to as 'real listener RL') actually records a sound source and a video. The recorded sound source and video are reproduced in a virtual space VS (refer to FIG. 1B) such as VR (Virtual Reality), AR (Augmented Reality) and MR (Mixed Reality) by the reproduction device 1, so that a user U different from the real listener RL can experience realistic sensations as if the user were in the acoustic space SS in a state of being in a real space RS such as a home.

Specifically, as shown in FIG. 1A, the reproduction device 1 is communicatively connected to a real speaker 200 arranged in the real space RS, and is configured to reproduce the recorded sound source with the real speaker 200. The reproduction device 1 also has a display 5 (refer to FIG. 3) capable of displaying the virtual space VS, and reproduces the recorded video with the display 5. Note that, FIG. 1A shows an example where the real speaker 200 is fixedly arranged in a predetermined position in the real space RS. However, the real speaker 200 may also be one that the user U wears, such as an earphone.

In the present disclosure, the realistic sensations in the virtual space VS is enhanced by the sound source that is reproduced with the real speaker 200 by executing a reproduction method shown in FIG. 1B by the reproduction device 1 according to the embodiment.

In the below, the reproduction method according to the embodiment is described with reference to FIG. 1B. Note that, FIG. 1B shows the virtual space VS as a view from above for convenience of descriptions. However, actually, the user U can see the videos in a variety of line-of-sight directions through a virtual listener VL as a viewpoint, with the reproduction device 1.

As shown in FIG. 1B, in the reproduction method according to the embodiment, the reproduction device 1 first acquires sound source information about a sound source recorded by a recording device 100 (step S1). Note that, the reproduction device 1 also acquires video information recorded by the recording device 100, together with the sound source information. The sound source information and the video information may be directly acquired from the recording device 100 or may also be acquired from a cloud server (not shown) in which the sound source information and the video information are stored. In addition, the sound source information and the video information may be acquired via a storage medium such as a CD (Compact Disc), a DVD (Digital Versatile Disc) and a flash memory.

Subsequently, in the reproduction method according to the embodiment, the reproduction device determines an output characteristic of the sound source with a virtual speaker 300 arranged in the virtual space VS, based on a positional relationship between the virtual speaker 300 and the virtual listener VL arranged in the virtual space VS (step S2). The output characteristic includes, for example, a sound source frequency characteristic, a phase characteristic, a gain characteristic (volume characteristic), and the like.

Specifically, in step S2, the reproduction device 1 first arranges the virtual speaker 300 and the virtual listener VL in the virtual space VS. The virtual speaker 300 and the virtual listener VL may be arranged in predetermined positions or may be arranged in positions designated by the user U. Then, the reproduction device 1 determines the output characteristic of the sound source with the virtual speaker 300, based on the positional relationship between the arranged virtual speaker 300 and virtual listener VL.

Specifically, the reproduction device 1 determines the output characteristic as if the user U were actually listening to the sound source in the acoustic space SS that is a real space, based on a direction in which the virtual speaker 300 exists with respect to the virtual listener VL or a distance from the virtual listener VL to the virtual speaker 300.

Specifically, in a case where the virtual listener VL is arranged in a center position of the four virtual speakers 300, the reproduction device 1 determines the output characteristic by which a sound source of an equal volume (gain) is output from each of the four virtual speakers 300 toward the virtual listener VL.

In a case where the virtual listener VL moves from the center position to the left of the drawing sheet of FIG. 1B, the reproduction device 1 increases volumes of the two virtual speakers 300 on the left of the drawing sheet and decreases volumes of the two virtual speakers 300 on the right of the drawing sheet, for example. Specifically, when the virtual listener VL moves to the left, the reproduction device determines the output characteristic as if the sound from a performer on a left side of a stage arranged in the virtual space VS were heard relatively loud and the sound from a performer on a right side of the stage were heard relatively quietly. Note that, the processing of determining the output characteristic will be described later in detail.

Subsequently, in the reproduction method according to the embodiment, the reproduction device reproduces the sound source with the real speaker 200 arranged in the real space RS (refer to FIG. 1A), based on the determined output characteristic (step S3). Specifically, the reproduction device 1 determines a real output characteristic of the real speaker 200 based on a positional relationship between the virtual speaker 300 and the real speaker 200, and reproduces the sound source based on the determined real output characteristic. Specifically, the reproduction device 1 sets the real output characteristic of the sound source with the real speaker 200 so as to be the output characteristic of the sound source with the virtual speaker 300.

Thereby, the sound source that is reproduced from the real speaker 200 has the output characteristic of the sound source with the virtual speaker 300. In other words, the sound source that is reproduced from the real speaker 200 enables the user U to feel as if the user were listening to the sound source in the acoustic space SS that is a real space. That is, according to the reproduction method according to the embodiment, it is possible to enhance the realistic sensations in the virtual space VS.

Figure 2:
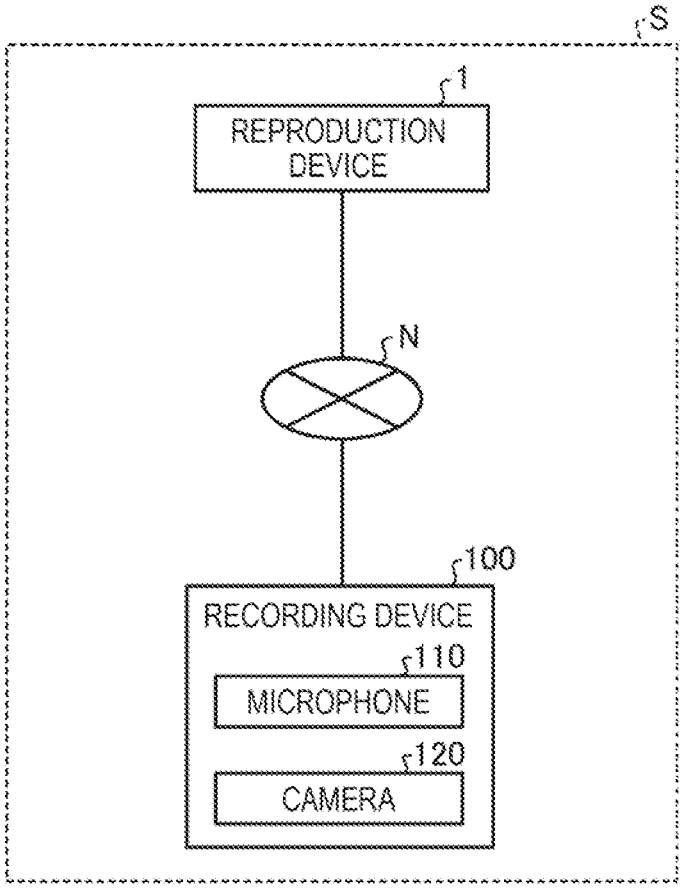
FIG. 2 is a block diagram showing a configuration example of a reproduction system according to the embodiment.

Subsequently, a configuration example of the reproduction system according to the embodiment is described with reference to FIG. 2. FIG. 2 is a block diagram showing a configuration example of a reproduction system S according to the embodiment.

As shown in FIG. 2, the reproduction system S includes the reproduction device 1 and the recording device 100, which are communicatively connected to each other via a communication network N such as Internet.

The reproduction device 1 is a device configured to execute the reproduction method according to the embodiment, and is a device capable of displaying a 3D virtual space VS such as VR and AR. The reproduction device 1 is, for example, a goggle type as shown in FIG. 1B. The reproduction device 1 may also be a smart phone, a tablet-type terminal, a laptop-type PC, a desktop computer or the like. The virtual space VS that is displayed on the reproduction device 1 is not limited to the 3D, and may also be a 2D.

The recording device 100 is a device configured to record a sound source and a video, and includes a microphone 110 for recording a sound that becomes a sound source, and a camera 120 for recording a video. The recording device 100 transmits sound source information about the sound source recorded by the microphone 110 and video information about the video recorded by the camera 120 to the reproduction device 1.

Note that, FIG. 2 shows an example where the sound source information and the video information are directly transmitted from the recording device 100 to the reproduction device 1. However, the recording device 100 may also be configured to transmit the sound source information and the video information to a cloud server (not shown). In this case, the reproduction device 1 may be configured to acquire the sound source information and the video information stored in the cloud server.

Figure 3:
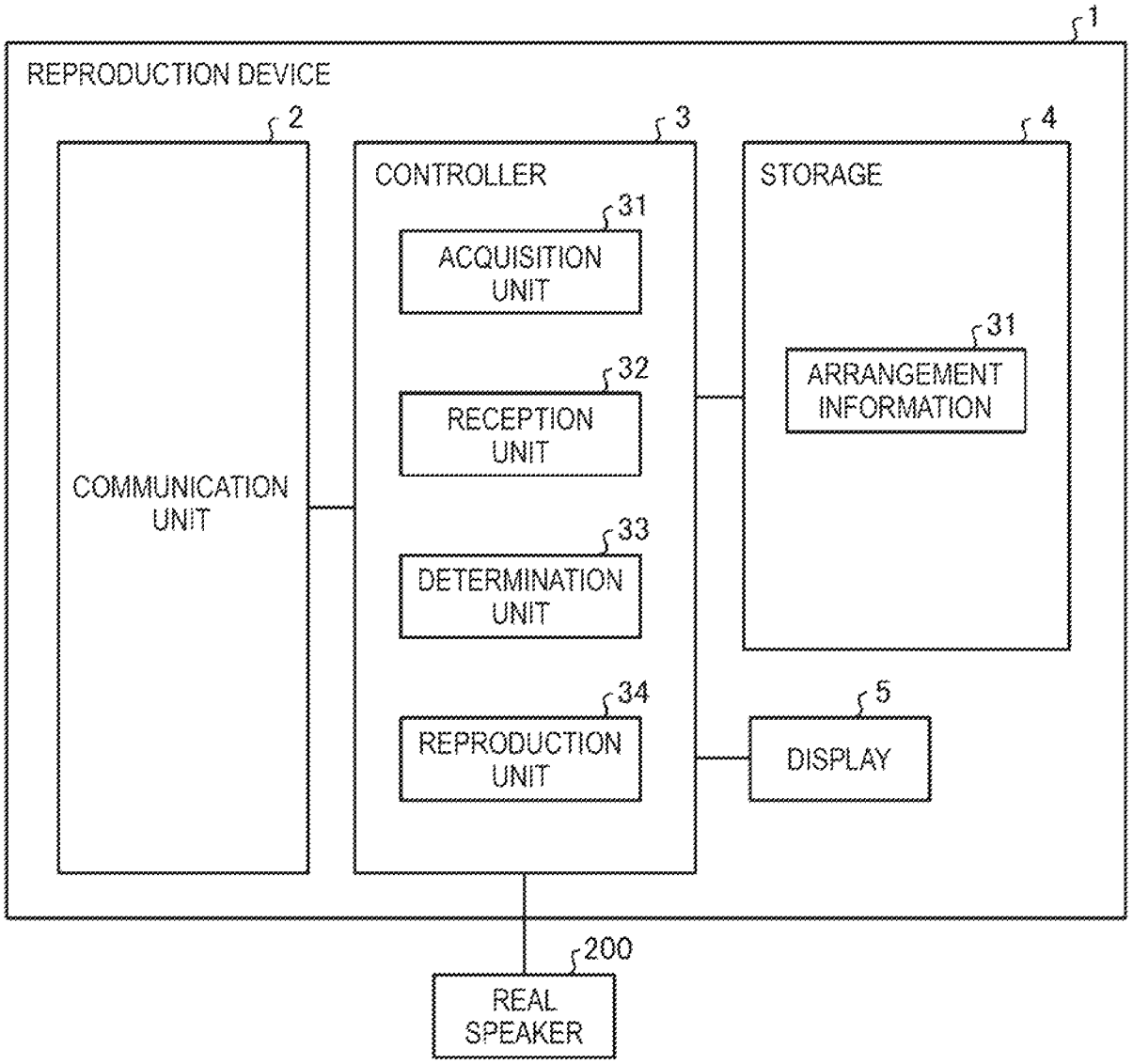
FIG. 3 is a functional block diagram showing a configuration example of a reproduction device according to the embodiment.

Subsequently, a configuration example of the reproduction device 1 according to the embodiment is described with reference to FIG. 3. FIG. 3 is a functional block diagram showing a configuration example of the reproduction device 1 according to the embodiment. Note that, in the block diagram of FIG. 3, only constitutional elements necessary to describe features of the present embodiment are shown as functional blocks and the general constitutional elements are not shown.

In other words, the respective constitutional elements shown in the block diagram of FIG. 3 are functionally conceptual, and are not necessarily required to be physically configured as shown. For example, the specific form of distribution or integration of the respective functional blocks is not limited to the shown form, and some or all thereof can be functionally or physically distributed or integrated in an arbitrary unit, depending on various loads, use situations and the like.

As shown in FIG. 3, the reproduction device 1 includes a communication unit 2, a controller 3, a storage 4, and a display 5. In addition, the reproduction device 1 is connected to the real speaker 200. The reproduction device 1 and the real speaker 200 are connected to each other via short-range wireless communication such as Bluetooth (registered trademark). On the other hand, the reproduction device 1 and the real speaker 200 may also be connected to each other in a wired manner.

Note that, FIG. 3 shows the example where the reproduction device 1 includes the display 5 (integration configuration). However, the display 5 may also be provided separately. In addition, the reproduction device 1 may be configured integrally with the real speaker 200.

The communication unit 2 is a communication interface for connecting to the communication network N in an interactive communication manner, and is configured to transmit and receive information to and from the recording device 100.

The controller 3 has an acquisition unit 31, a reception unit 32, a determination unit 33 and a reproduction unit 34, and includes a computer having a CPU (Central Processing Unit), a ROM (Read Only Memory), a RAM (Random Access Memory), a hard disk drive, an input/output port, and the like, and a variety of circuitry.

The CPU of the computer is configured to read out and execute a program stored in the ROM, for example, thereby functioning as the acquisition unit 31, the reception unit 32, the determination unit 33 and the reproduction unit 34 of the controller 3.

In addition, at least some or all of the acquisition unit 31, the reception unit 32, the determination unit 33 and the reproduction unit 34 of the controller 3 may be configured by hardware such as ASIC (Application Specific Integrated Circuit), FPGA (Field Programmable Gate Array) or the like.

The storage 4 is a storage constituted by a storage device such as a non-volatile memory, a data flash, a hard disk drive and the like, for example. In the storage 4, arrangement information 41, a variety of programs and the like are stored.

The arrangement information 41 is information including position information of the real speaker 200. For example, the position information of the real speaker 200 is information of relative positions of the user U and the real speaker 200. In addition, the position information of the real speaker 200 may be coordinate information indicative of an absolute position in the real space RS. Note that, the position information of the real speaker 200 may be registered in advance by the user U. Alternatively, the reproduction device 1 may include a camera (not shown), and the position information of the real speaker 200 may be detected by an image captured by the camera.

In a case where the reproduction device 1 and the real speaker 200 are wirelessly connected, the position information of the real speaker 200 may be detected based on an arrival direction and a signal intensity of a communication signal.

The display 5 is a display capable of displaying the virtual space VS.

Subsequently, the respective functions (the acquisition unit 31, the reception unit 32, the determination unit 33 and the reproduction unit 34) of the controller 3 are described.

The acquisition unit 31 acquires a variety of information. For example, the acquisition unit 31 acquires the sound source information about the sound source from the recording device 100. The sound source may include any type of sound such as audio, instrumental sound, digital sound and the like.

The acquisition unit 31 also acquires the video information about the video recorded by the recording device 100, together with the sound source information. Note that, the acquisition unit 31 may also be configured to separately acquire the sound source information and the video information or to acquire information where the sound source information and the video information are integrated, such as a moving image.

The acquisition unit 31 also acquires the position information of the real speaker 200 in the real space RS. A position of the real speaker 200 is expressed as a relative position (a relative direction and a relative distance) to the user U. The position of the real speaker 200 may be input (designated) by the user U. Alternatively, the reproduction device 1 may include a camera (not shown), and the position of the real speaker 200 may be acquired as a position of the real speaker 200 recognized by an image captured by the camera.

The acquisition unit 31 also acquires acoustic information about an acoustic characteristic in the acoustic space SS when the sound source is recorded in the acoustic space SS that is a real space. The acoustic information includes, for example, a reflection characteristic information about a reflection characteristic of sound on a reflector (for example, a wall or the like) present in the acoustic space SS.

For example, the acquisition unit 31 estimates a material of the reflector, based on a captured image obtained by imaging the reflector, such as the video information, and acquires (estimate) reflection characteristic information corresponding to the estimated material. The reflection characteristic information is, for example, information about a reflectance of sound. Note that, the reflectance may be a reflectance of the entire sound or may be a reflectance for each frequency band of the sound source.

The acoustic information also includes information (information about the number of persons and the presence positions thereof) about a person in the acoustic space SS that is a real space. This is because the acoustic characteristic changes according to the number of persons in the acoustic space SS, that is, the more the persons are, the less the sound source is reflected. Note that, in a case where another user is present as an avatar in the virtual space VS, the sound source information may include information about the avatar (information about the number of avatars and the presence positions thereof).

The reception unit 32 receives a variety of information from the user U. For example, the reception unit 32 receives a designation of a listening direction starting from the virtual listener VL in the virtual space VS. Note that, the listening direction will be described later in detail with reference to FIG. 4.

The reception unit 32 also receives a position change of the virtual listener VL. The reception unit 32 also receives a reproduction instruction for the sound source and the video.

The determination unit 33 determines the output characteristic of the sound source with the virtual speaker 300, based on the positional relationship between the virtual speaker 300 arranged in the virtual space VS and the virtual listener VL arranged in the virtual space VS.

Specifically, the determination unit first arranges the virtual speaker 300 and the virtual listener VL in the virtual space VS. The virtual speaker 300 may be arranged in a predetermined position or may be arranged in a position designated by the user U. The determination unit 33 may also recognize a transmission source (a performer, an audience and the like) of sound from the video information acquired by the acquisition unit 31, and to arrange the virtual speaker 300 in a position corresponding to the transmission source. Alternatively, the determination unit 33 may also set a position corresponding to the position of the recording device 100 (refer to FIG. 1A), as the position of the virtual speaker 300.

After the user U enters (logs in) the virtual space VS, the virtual listener VL is arranged in a predetermined initial position. After being arranged in the initial position, the virtual listener VL can be moved in the virtual space VS by a moving operation (an operation using a mouse, a keyboard or the like) of the user U.

The initial position of the virtual listener VL may be a predetermined position or may be any position selected by the user U. In addition, in a case where a plurality of virtual listeners VL can enter (a plurality of users U can log in) the virtual space VS, for example, the virtual listeners VL may be sequentially arranged in predetermined positions in order of the entry. Specifically, in a case where seats are arranged in the virtual space VS like a concert hall, the virtual listeners VL may be arranged in positions of the seats in order of the entry or may be arranged in positions of the seats designated (tickets of which are bought) in advance by the user U.

The determination unit 33 determines the output characteristic of the sound source with the virtual speaker 300, based on the positional relationship between the position (initial position or position after movement) of the virtual listener VL and the position of the virtual speaker 300. The output characteristic includes, for example, a frequency characteristic, a phase characteristic, a gain characteristic, a directivity characteristic, and the like of the sound source. Note that, a final position of the virtual listener VL is a position arranged at a time when the reception instruction is received by the reception unit 32.

Specifically, the determination unit 33 sets a predetermined position in a real space such as a concert hall as a position of the virtual listener VL, and determines the output characteristic of the sound source with the virtual speaker 300 so that the sound source that is the same as a sound source, which is actually listened in the predetermined position in the real space, can be listened in the position of the virtual listener VL.

Specifically, the determination unit 33 determines the output characteristic as if the user U were actually listening to the sound source in the acoustic space SS, which is a real space, based on a direction in which the virtual speaker 300 is present with respect to the virtual listener VL or a distance from the virtual listener VL to the virtual speaker 300.

More specifically, the determination unit 33 determines a direction of the virtual listener VL from the virtual speaker 300, as a directivity direction (directivity) of sound, and to determine so that the volume (gain characteristic) is reduced as the distance from the virtual speaker 300 to the virtual listener VL increases.

For example, in a case where the sound source is an orchestra, when a position of the virtual listener VL is arranged to the left of a performer group, the determination unit 33 increases the volume (gain) of the virtual speaker 300 arranged on the left side of the performer group, and reduces the volume (gain) of the virtual speaker 300 arranged on the right side. Thereby, the user U who does not enter the concert hall can listen to the sound source in the virtual space VS as if the user actually were in the concert hall. In other words, the realistic sensations can be enhanced.

In a case where the performers play music at the front and the audiences are present at the rear in the concert hall, when the position of the virtual listener VL is arranged to the rear, the determination unit 33 reduces the volume of the virtual speaker 300 arranged at the front and increases the volume of the virtual speaker 300 at the rear. Specifically, as for the sound source that is heard in the position of the virtual listener VL, the sound of the performers becomes small and the sound (buzzing sound) of the audience becomes large.

When the acoustic information of the acoustic space SS is acquired by the acquisition unit 31, the determination unit 33 determines the output characteristic, in consideration of the acoustic information. Specifically, the determination unit 33 estimates a reverberating sound, which is generated when a sound output from the virtual speaker 300 is reflected on the reflector and reaches the virtual listener VL, based on a distance from the reflector such as a wall in the acoustic space SS to the virtual listener VL, a distance from the virtual speaker 300 to the reflector, and a reflectance (reflection characteristic information) of the sound on the reflector. Accordingly, since the position and apparent shape of the reflector or the like are different according to the position of the virtual listener VL, the output characteristic is changed in accordance with the position of the virtual listener VL. Then, the determination unit 33 determines the output characteristic of the acoustic sound source where the estimated reverberating sound is added to the sound source directly reaching the virtual listener VL from the virtual speaker 300.

Specifically, the determination unit 33 determines the output characteristic of the acoustic sound source by combining the output characteristic of the sound source and the output characteristic of the reverberating sound. Note that, the output characteristic of the reverberating sound is an output characteristic whose high-frequency component (highly attenuated frequency component) is reduced, a phase is delayed or a gain (volume) is reduced with respect to the output characteristic of the sound source. In this way, since the determination unit 33 can add the reverberating sound component to the sound source, which is reproduced by the reproduction unit 34 at the subsequent stage, by determining the output characteristic, in consideration of the acoustic information, the user U can listen to the sound source as if the user were listening to the sound source in the acoustic space SS.

In addition, when the acoustic information includes the information (information about the number of persons and the presence positions thereof) about a person in the acoustic space SS that is a real space and the information about the avatar of another person in the virtual space VS, the determination unit 33 may also determine the output characteristic of the sound source based on the information.

Specifically, the determination unit 33 determines the output characteristic so that the more the audiences exist in the acoustic space SS which is a real space, or the more the avatars exist in the virtual space VS, the greater the attenuation of the sound source is.

The reproduction unit 34 reproduces the sound source via the real speaker 200 arranged in the real space RS, based on the output characteristic determined by the determination unit 33. Specifically, the reproduction unit 34 first sets the real speaker 200 in the virtual space VS.

Specifically, the reproduction unit 34 sets a relative position of the real speaker 200 to the virtual listener VL in the virtual space VS so as to be the same as the relative position of the real speaker to the user U. Note that, when the virtual listener VL moves, the real speaker 200 also moves similarly. Specifically, the relative position of the real speaker 200 to the virtual listener VL is set to be constant all the time.

The reproduction unit 34 determines a real output characteristic of the sound source that is output from the real speaker 200, based on the positional relationship between the virtual speaker 300 and the real speaker 200, and reproduces the sound source based on the determined real output characteristic. Note that, the real output characteristic includes, for example, a frequency characteristic, a phase characteristic, a gain characteristic, a directivity characteristic, and the like. Specifically, the reproduction unit executes acoustic signal processing by using an acoustic transfer function and the like so that a characteristic of an arrival sound at a time when the output sound from the virtual speaker 300 arrives at the virtual listener VL and a characteristic of an arrival sound at a time when the output sound from the real speaker 200 arrives at a real listener (user U) are to be the same.

Specifically, the reproduction unit 34 determines the real output characteristic by correcting the output characteristic of the sound source to be output from the real speaker 200 so as to be the output characteristic determined by the determination unit 33. Then, the reproduction unit 34 reproduces the sound source of the determined real output characteristic from the real speaker 200. In this way, the real output characteristic of the real speaker 200 is determined based on the positional relationship between the virtual speaker 300 and the real speaker 200, so that the sound source with higher realistic sensations can be reproduced.

The reproduction unit 34 also reproduces the video information acquired by the acquisition unit 31, together with the sound source. Specifically, the reproduction unit 34 is detects a face direction of the user who wears the reproduction device 1, which is a VR device, and to display the video in a line-of-sight direction (a line-of-sight direction starting from the virtual listener VL) corresponding to the face direction. Note that, the line-of-sight direction may also be received as a button operation of the user U or an operation by an operation member such as a joystick.

Figure 4:
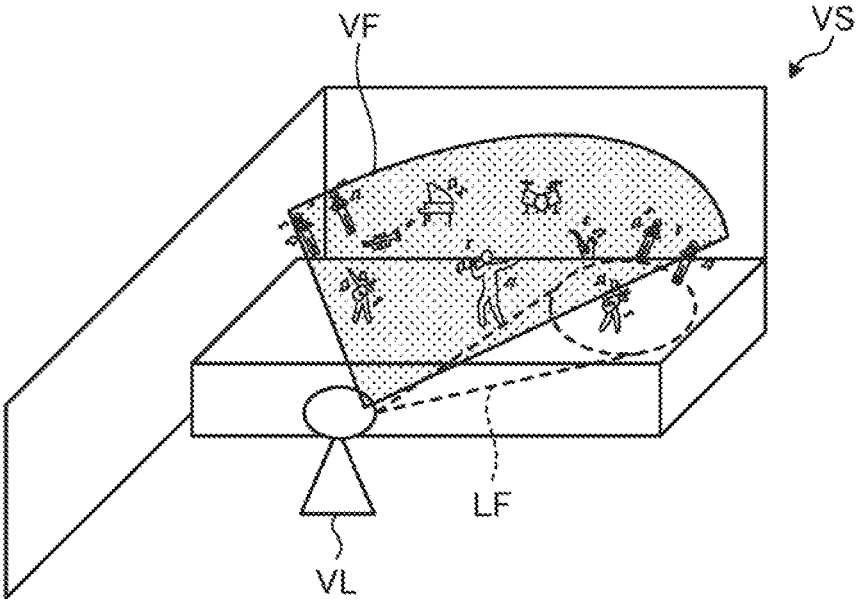
FIG. 4 shows an example where a sound source in a listening direction is emphasis-reproduced.

Note that, when reproducing the sound source, the reproduction device 1 may enable the user U to hear the sound source from a specific direction (listening direction) in the virtual space VS. This is described with reference to FIG. 4. FIG. 4 shows an example where an audio source in a listening direction is emphasis-reproduced.

FIG. 4 shows an example where while the line-of-sight direction VF (a line-of-sight range) of the virtual listener VL faces toward the front of the stage, the listening direction received by the reception unit 32 is a right direction of the stage.

In this case, the reproduction device 1 reproduces the sound source so that the sound source on the right side of the stage becomes large, while displaying a video of the entire stage based on the line-of-sight direction VF. Specifically, the determination unit 33 increases a gain of the virtual speaker 300 corresponding to the received listening direction, and reduces (or to zero) a gain of the virtual speaker 300 deviating from the listening direction. Thereby, the user U can listen to the sound source emphasized on the right side of the stage, i.e., in the listening direction.

Note that, FIG. 4 shows the example where the sound source in the listening direction is emphasized. However, for example, the sound source in the listening direction may be erased singly.

Figure 5:
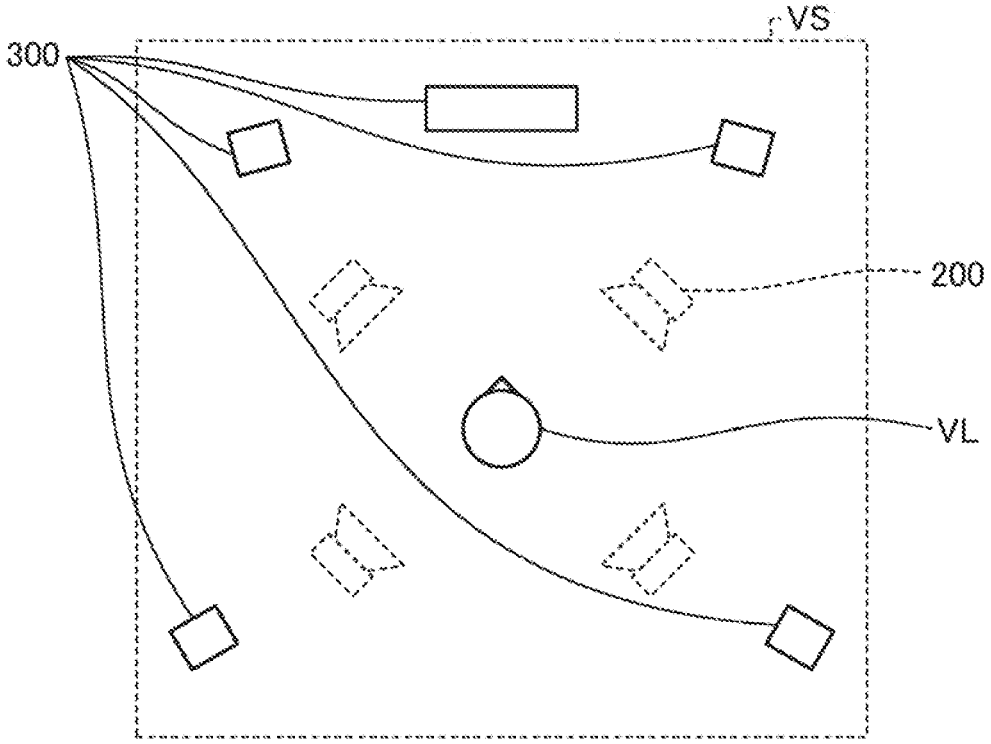
FIG. 5 shows pseudo-surround processing.

Subsequently, an implementation example of a pseudo-surround system is described with reference to FIG. 5. FIG. 5 shows pseudo-surround processing. FIG. 5 shows an example where the five (for example, 5.1ch) virtual speakers 300 are arranged and the four real speakers 200 are arranged in the virtual space VS. Specifically, the reproduction device 1 reproduces pseudo-5.1ch surround sound sources by the sound sources that are output from the four real speakers 200.

Specifically, the reproduction unit 34 corrects attenuation amounts and phases of the sound sources output from the real speakers 200 by distances and directions (angles) from the real speakers 200 to the respective virtual speakers 300, thereby determining the real output characteristics and reproducing the sound sources. Thereby, even when the number of channels of the real speakers 200 and the number of channels of the virtual speakers 300 are different (particularly, even when the number of channels of the virtual speakers 300 is larger), it is possible to reproduce the sound sources pseudo-matched to the number of channels of the virtual speakers 300 from the real speakers 200, so that it is possible to enhance the realistic sensations in the virtual space VS.

Figure 6:
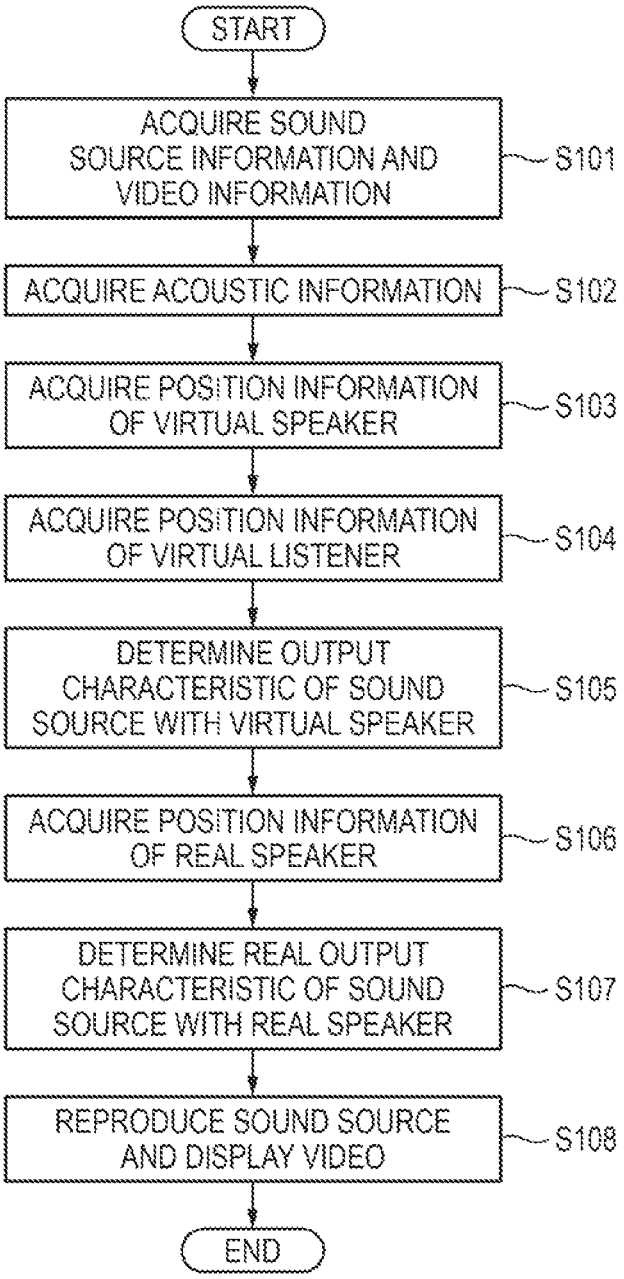
FIG. 6 is a flowchart showing a processing procedure of processing that is executed by the reproduction device according to the embodiment.

Subsequently, a processing procedure that is executed in the reproduction device 1 according to the embodiment is described with reference to FIG. 6. FIG. 6 is a flowchart showing a processing procedure of processing that is executed by the reproduction device 1 according to the embodiment.

As shown in FIG. 6, the acquisition unit 31 first acquires the sound source information about the sound source recorded by the recording device 100 and the video information recorded by the recording device 100 (step S101).

Subsequently, the acquisition unit 31 acquires the acoustic information about the acoustic characteristic in the acoustic space SS (step S102). For example, the acquisition unit 31 estimates the reflection characteristic information about the reflection characteristic of sound on the wall surrounding the acoustic space SS, based on the video information recorded by the recording device 100, and acquires the estimated reflection characteristic information, as the acoustic information.

Subsequently, the acquisition unit 31 acquires the position information of the virtual speaker 300 in the virtual space VS (step S103).

Subsequently, the acquisition unit 31 acquires the position information of the virtual listener VL (step S104).

Subsequently, the determination unit 33 determines the output characteristic of the sound source with the virtual speaker 300, based on the positional relationship between the virtual speaker 300 and the virtual listener VL (step 105).

Subsequently, the acquisition unit 31 acquires the position information of the real speaker 200 (step S106).

Subsequently, the reproduction unit 34 determines (corrects) the real output characteristic of the sound source with the real speaker 200, based on the output characteristic determined by the determination unit 33 (step S107).

Subsequently, the reproduction unit 34 reproduces the sound source via the real speaker 200, based on the determined real output characteristic, displays the video information via the display 5 (step S108), and ends the processing.

As described above, the reproduction device 1 of the embodiment includes the acquisition unit 31, the determination unit 33 and the reproduction unit 34. The acquisition unit 31 acquires the sound source information about the sound source. The determination unit 33 determines the output characteristic of the sound source with the virtual speaker 300, based on the positional relationship between the virtual speaker 300 arranged in the virtual space VS and the virtual listener VL arranged in the virtual space VS. The reproduction unit 34 reproduces the sound source via the real speaker 200 arranged in the real space RS, based on the output characteristic determined by the determination unit 33. Thereby, it is possible to enhance the realistic sensations.

The additional effects and modified embodiments can be easily conceived by one skilled in the art. For this reason, the wider aspect of the present invention is not limited to the details and representative embodiment as shown and described above. Accordingly, a variety of changes can be made without departing from the conceptual spirit or scope of the general inventions defined in the appended claims and equivalents thereof.

What is claimed is:

1. A reproduction device comprising:

a hardware processor configured to acquire (i) sound source information about a sound source recorded in an acoustic space and (ii) acoustic information about an acoustic characteristic in the acoustic space, the acoustic information including reflection characteristic information about a reflection characteristic of sound estimated based on a captured image obtained by imaging the acoustic space;

determine an output characteristic of the sound source with a virtual speaker arranged in a virtual space, based on the acoustic information and a positional relationship between the virtual speaker and a virtual listener arranged in the virtual space; and reproduce the sound source with a real speaker arranged in a real space, based on the determined output characteristic.

2. The reproduction device according to claim 1, wherein the reflection characteristic information is about a reflection characteristic of sound on a reflector present in the acoustic space.

3. The reproduction device according to claim 2, wherein the captured image is obtained by imaging the reflector.

4. The reproduction device according to claim 1, wherein the hardware processor is configured to receive a designation of a listening direction starting from the virtual listener; and determine the output characteristic, based on the listening direction, the acoustic information, and a positional relationship.

5. The reproduction device according to claim 4, wherein the hardware processor is configured (i) to determine a real output characteristic of the sound source that is output from the real speaker, based on a positional relationship between the virtual speaker and the real speaker, and (ii) to reproduce the sound source based on the determined real output characteristic.

6. The reproduction device according to claim 1, wherein the hardware processor is configured (i) to determine a real output characteristic of the sound source that is output from the real speaker, based on a positional relationship between the virtual speaker and the real speaker, and (ii) to reproduce the sound source based on the determined real output characteristic.

7. A reproduction device comprising:

a hardware processor configured to acquire sound source information about a sound source;

receive a designation of a listening direction starting from a virtual listener arranged in a virtual space;

determine an output characteristic of the sound source with a virtual speaker arranged in the virtual space, based on the listening direction and a positional relationship between the virtual speaker and the virtual listener; and reproduce the sound source with a real speaker arranged in a real space, based on the determined output characteristic.

8. The reproduction device according to claim 7, wherein the hardware processor is configured (i) to determine a real output characteristic of the sound source that is output from the real speaker, based on a positional relationship between the virtual speaker and the real speaker, and (ii) to reproduce the sound source based on the determined real output characteristic.

9. The reproduction device according to claim 7, wherein the sound source is a sound source recorded in an acoustic space, and the hardware processor is configured to acquire acoustic information about an acoustic characteristic in the acoustic space, and to determine the output characteristic based on the acoustic information.

10. The reproduction device according to claim 9, wherein the acoustic information includes reflection characteristic information about a reflection characteristic of sound on a reflector present in the acoustic space.

11. A reproduction device comprising:

a hardware processor configured to acquire sound source information about a sound source;

determine an output characteristic of the sound source with a virtual speaker arranged in a virtual space, based on a positional relationship between the virtual speaker and a virtual listener arranged in the virtual space;

determine a real output characteristic of the sound source that is output from a real speaker arranged in a real space, based on a positional relationship between the virtual speaker and the real speaker; and reproduce the sound source with the real speaker based on the determined real output characteristic.

12. The reproduction device according to claim 11, wherein the sound source is a sound source recorded in an acoustic space, and the hardware processor is further configured to acquire acoustic information about an acoustic characteristic in the acoustic space, and to determine the output characteristic based on the acoustic information.

13. The reproduction device according to claim 12, wherein the acoustic information includes reflection characteristic information about a reflection characteristic of sound on a reflector present in the acoustic space.

14. A reproduction method comprising:

acquiring (i) sound source information about a sound source recorded in an acoustic space and (ii) acoustic information about an acoustic characteristic in the acoustic space, the acoustic information including reflection characteristic information about a reflection characteristic of sound estimated based on a captured image obtained by imaging the acoustic space;

determining an output characteristic of the sound source with a virtual speaker arranged in a virtual space, based on the acoustic information and a positional relationship between the virtual speaker and a virtual listener arranged in the virtual space; and reproducing the sound source with a real speaker arranged in a real space, based on the determined output characteristic.

15. A reproduction method comprising:

acquiring sound source information about a sound source;

receiving a designation of a listening direction starting from a virtual listener arranged in a virtual space;

determining an output characteristic of the sound source with a virtual speaker arranged in the virtual space, based on the listening direction and a positional relationship between the virtual speaker and the virtual listener; and reproducing the sound source with a real speaker arranged in a real space, based on the determined output characteristic.

16. A reproduction method comprising:

acquiring sound source information about a sound source;

determining an output characteristic of the sound source with a virtual speaker arranged in a virtual space, based on a positional relationship between the virtual speaker and a virtual listener arranged in the virtual space;

determining a real output characteristic of the sound source that is output from a real speaker arranged in a real space, based on a positional relationship between the virtual speaker and the real speaker; and reproducing the sound source with the real speaker based on the determined real output characteristic.

* * * * *